United States Patent [19]

Sanders

[11] 4,082,209

[45] Apr. 4, 1978

[54] GOLF BALL HOLDER

[76] Inventor: Davis J. Sanders, 18030 4th Ave. S., Seattle, Wash. 98148

[21] Appl. No.: 741,210

[22] Filed: Nov. 12, 1976

[51] Int. Cl.[2] ..... B60R 9/08

[52] U.S. Cl. ..... 224/29 B; 224/5D; 221/309; 211/15

[58] Field of Search ..... 224/5 D, 29 B, 45 L, 224/15, 16, 29 R; 221/303, 307, 309; 211/14, 15

[56] References Cited

U.S. PATENT DOCUMENTS

| | | | |
|---|---|---|---|
| 1,576,010 | 3/1926 | Swartz | 224/15 UX |
| 1,754,495 | 4/1930 | Anderson | 224/5 D UX |
| 1,829,093 | 10/1931 | Hollins | 224/5 D X |
| 2,664,933 | 1/1954 | Gielow | 221/309 X |
| 2,756,914 | 7/1956 | Bonderer | 224/5 D X |
| 3,281,013 | 10/1966 | Motard | 224/5 D |
| 3,733,086 | 5/1973 | Walkerow | 224/29 B X |

*Primary Examiner*—Galen L. Barefoot

*Assistant Examiner*—Jerold M. Forsberg

*Attorney, Agent, or Firm*—Robert B. Hughes

[57] ABSTRACT

A golf ball holder comprising a rigid cylindrical housing having an upper retaining chamber and a lower dispensing chamber. At the lower end of the housing, adjacent the dispensing chamber, there is a lateral opening moderately larger than the size of the golf balls to be retained. A resilient retaining finger extends upwardly a moderate distance into the dispensing chamber to prevent golf balls in the container from dropping fully in the dispensing chamber. Golf balls can be moved laterally into and from the dispensing chamber by depressing the retaining finger either by hand contact or with the golf ball as it is moved either into or from the dispensing chamber portion. A pair of vertically spaced closure members at the top of the housing have circumferentially spaced mounting holes in which golf tees can be conveniently located.

3 Claims, 4 Drawing Figures

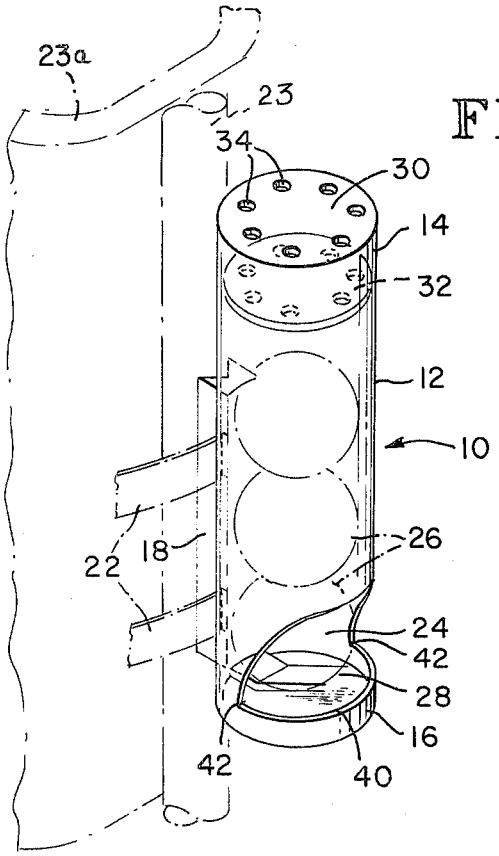
FIG. 1
FIG. 2
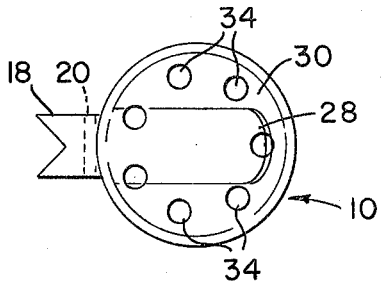
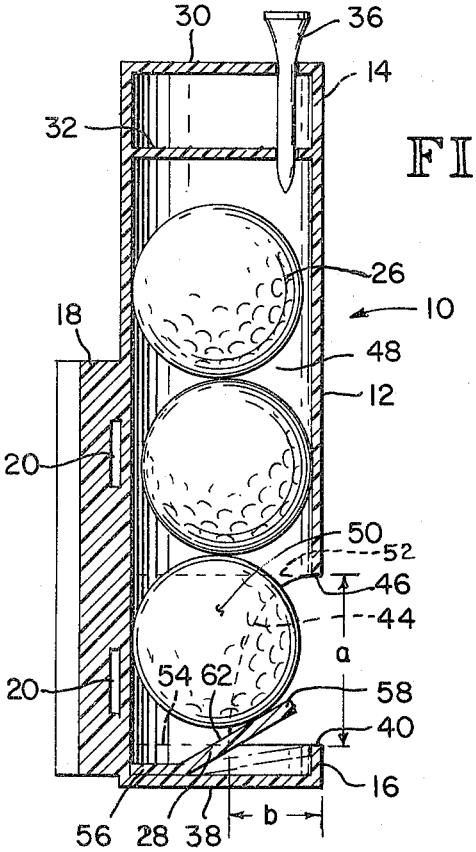
FIG. 3
FIG. 4
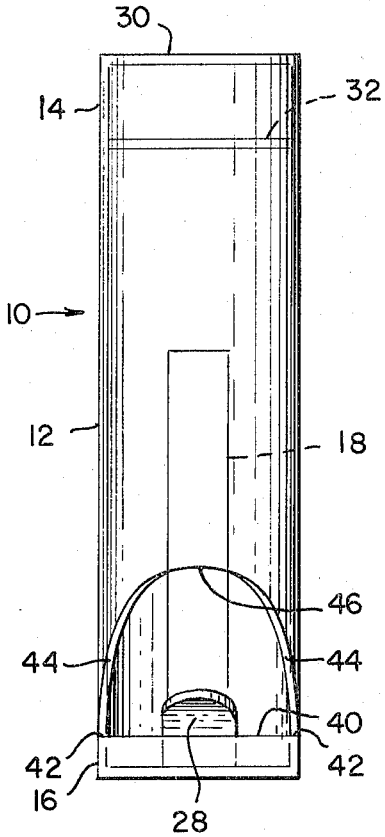

GOLF BALL HOLDER

BACKGROUND OF THE INVENTION

A. Field of the Invention

The present invention relates to a golf ball holder adapted for use during a golf game, by which golf balls can be stored in the holder and conveniently be taken from or inserted into the holder.

B. Description of the Prior Art

There are in the prior art various golf ball holders in which a number of golf balls are stacked in a cylindrical housing, with the golf balls being able to be dispensed one at a time from the lower end of the housing. During actual play of a golf game, this provides the player with a convenient means of obtaining a new golf ball when the previous golf ball is either lost or damaged.

Typical of these devices is one shown in the Houser patent, U.S. Pat. No. 2,768,775, where a plurality of golf balls are held in a vertical cylindrical housing, having two inwardly reaching fingers which form with the lower edge of the housing a circumference moderately smaller than the circumference of the golf ball. By pushing the golf ball against the resilient fingers, these fingers are deflected outwardly, and the golf ball can then be removed from the holder. A somewhat similar arrangement is shown in the Morss patent, U.S. Pat. No. 1,778,225, except that in this device, the retaining member is an annular rubber retainer having an inside diameter moderately smaller than that of the golf ball. The golf ball is moved out of the holder by deflecting the annular retainer to a greater diameter so that the golf ball can be moved from the holder. A somewhat modified arrangement is shown in the Naggar patent, U.S. Pat. No. 3,497,118, where there are several sets of opposed fingers which reach around the golf balls to hold them in the container. The golf ball is removed by pressing it directly against the resilient fingers to push them out of the way and thus remove the ball from the container.

In all three of the patents noted above, there is the common characteristic that the ball, in being removed from the container, is moved in a direction generally directly opposite to the urging of the retaining members. While this arrangement is operable, there is the difficulty that if the retaining member is made quite resistant to deflection so that it can retain the ball quite securely, it becomes difficult to remove the ball from the container. On the other hand, if the retaining member can be deflected with not too much force, the ball can quite easily become accidently dislodged from the container, such as in the course of the normal jostling of a golf bag or the like to which the container might be mounted.

Another approach to this problem is shown in the Joliot patent, U.S. Pat. No. 3,777,933, in which there is a stationary wire mounting member with a lower substantially rigid retaining portion. There is a cylindrical container attached to the wire mounting member in a manner that it is vertically movable. Thus, the cylindrical container itself is moved upwardly to permit a golf ball to be dispensed, and moved downwardly to permit another golf ball to be inserted at the upper end of the container. While this golf ball holder is an operable device, it requires relative movement of the major components to operate the device.

The Motard patent, U.S. Pat. No. 3,281,013, shows a cylindrical container having a wire retaining member at the lower end thereof. This wire retaining member has upper and lower retaining fingers which are movable laterally in a manner that movement in one direction dispenses a lower ball from a lower position, and movement back to the original position permits the next upper golf ball to drop into the dispensing position. Again, this dispenser requires the assembly of components which are relatively movable to make an operable device.

The Anderson patent, U.S. Pat. No. 1,754,495, takes a somewhat different approach by simply providing a removable cap at the bottom end of the containing cylinder. Thus, to remove a golf ball, the cap is removed, the golf ball taken out of the cylinder and the cap put back in place.

Finally, the Miotke patent, U.S. Pat. No. 3,186,593, shows a more sophisticated device for dispensing golf balls onto the ground. This device has a pair of retaining members which can be deflected from their retaining position by movement of a cylindrical actuating member vertically with respect to the cylindrical container. This device serves a substantially different function in that it is designed to place golf balls directly onto the ground.

While the prior art does show a variety of devices which are operable to contain and dispense golf balls, there is a continuing need to provide such a device which lends itself to rather simple construction, desirably of a type which can be made as one integral piece, which has the reliability of securely retaining golf balls and yet provides the convenience of permitting the golf balls to be easily inserted and removed from the device. It is an object of the present invention to provide such an apparatus.

SUMMARY OF THE INVENTION

The holder of the present invention comprises an elongate, substantially rigid housing, desirably in a cylindrical configuration, defining an upper retaining chamber and a lower dispensing chamber. The interior of the housing has lateral dimensions moderately large than the golf balls to be retained, so that the balls are vertically stacked in the holder.

At the lower end of the housing there is a laterally and forwardly facing opening, moderately larger than the diameter of the retained golf balls. This opening has an upper edge generally coincident with a first horizontal plane that defines the upper limit of the dispensing chamber, and a lower edge generally coincident with a second horizontal plane defining a lower limit of the dispensing chamber. In the preferred form, the opening has an upper curved edge having a radius of curvature only moderately larger than that of the golf balls, so that a ball adjacent the upper edge of the opening is better retained in the holder. At the lower portion of the opening, the opening is laterally expanded to permit a person to more easily reach into the opening to grasp a golf ball and move it through the opening.

A retaining finger reaches into the dispensing chamber at a location above the second lower plane that defines the lower limit of the dispensing chamber. Desirably, this finger is cantilever mounted from a lower rear portion of the holder, and reaches upwardly and forwardly into the dispensing chamber. The finger has an upwardly directed face adapted to engage a lower side of a lowermost retained ball and hold the ball in a position partly in the dispensing chamber and partly in the retaining chamber, so that with the ball so retained, edge portions of the housing adjacent the ball coact with the finger to securely retain the ball in the lower portion of the holder. The retaining finger is resiliently mounted so as to be readily downwardly deflected by a downwardly directed force, so as to permit the lowermost golf ball to be positioned entirely in the dispensing chamber by application of such downward force, and then moved laterally to the dispensing opening.

In the preferred form, the upper portion of the housing is closed by a plate, fixedly secured thereto, which not only provides structural rigidity, but also has circumferentially spaced holes to receive golf tees therein. In the preferred form, there is a second lower golf tee retaining member, also having holes which are vertically aligned with the holes in the upper closure member.

At the rear side of the holder, there is convenient mounting means, by which the holder can be mounted to a golf cart or the like. This can most easily be provided by a vertically aligned member having vertically placed slots through which straps can be inserted.

The holder of the present invention can conveniently be made as a unitary piece with no moving parts, except for the resilient deflection of the retaining finger. Golf balls can be quite easily inserted into and removed from the holder, and in the retained position the golf balls are securely held in the device. In the event of jostling or sharp impacts with the device, the resilient finger coacts with the edge portions defining the dispensing opening to keep the golf balls properly retained.

BRIEF DESCRIPTION OF THE DRAWINGS

FIG. 1 is a perspective view of the golf ball holder of the present invention;

FIG. 2 is a top view of the holder;

FIG. 3 is a side view of the holder; and

FIG. 4 is a front elevational view thereof.

DESCRIPTION OF THE PREFERRED EMBODIMENT

The golf ball holding device 10 of the present invention is intended for use during actual golf play. It comprises an elongate tubular cylindrical housing 12 having upper and lower ends 14 and 16, respectively. Secure to one side of the housing is a vertically aligned mounting member 18 having upper and lower slots 20 to receive a pair of straps, indicated in dotted lines at 22 by which the device 10 can be mounted to a golf cart to which a golf bag is mounted, these being shown in dotted lines at 23 and 23*a*. In describing the device 10, the location of the mounting member 18 will be considered the rear of the device, and the opposite side of the device, which in actual use would be facing away from the golf bag to which it is mounted, will be considered the forward or front side of the device 10. While the mounting member 18 is shown as extending only to the mid-height of the device 10, it can just as well extend the entire length thereof.

At the lower front end of the device 10, there is a dispensing opening 24, through which golf balls, indicated at 26, can be inserted into the device 10 or removed therefrom. At the location of the dispensing opening 24 there is a retaining finger 28 which, as its name implies, functions to hold the balls 26 securely in the container 10, and yet permit easy removal and insertion of the balls 26. The particular arrangement of the opening 24 and the retaining finger 28 are quite critical in the present invention and will be discussed in more detail later herein.

At the upper end 14 of the container 10, there is a top disc-like closure member 30, and a second lower disc-like member 32 fixedly secured to the housing 12. The discs 30 and 32 have pairs of vertically aligned holes 34 arranged in a circular pattern next to the circumference of the discs 30 and 32, these holes 34 being arranged to receive golf tees 36 which can be inserted in the holes 34 from a location above the container 10. As can be seen in FIGS. 3 and 4, the spacing of the disc members 30 and 32 and the location of the holes 34 are such that a golf ball 26 positioned in the uppermost part of the container 10 will not dislodge any golf tees 36 positioned in the holes 34. As an alternate configuration, the two disc members 30 and 32 could be made as a single piece.

At the lower end of the housing 12, there is a bottom disc-like closure member 38 integral with or securely bonded to the lower edge of the housing 12. While the closure member 38 is not a necessary component in terms of the golf ball retaining and dispensing function of the apparatus 10, it does provide structural rigidity for the housing 12 and also provides a base from which the retaining finger 28 can be mounted. It is also possible to form the retaining finger 28 by displacing some of the material from the bottom closure member 38 upwardly.

To discuss more specifically the functional relationship between the dispensing opening 24 and the retaining finger 28, it can be seen that the opening 24 is defined by a lower edge 40 positioned in a single horizontal plane and having a semicircular configuration. At the terminal ends 42 of the lower edge 40, there begins a second edge portion made up of two lateral edge portions 44 and an upper edge portion 46. The lateral edge portion 44 and the upper edge portion 46 collectively define a substantially continuous curved edge member which is so configured that in its side elevational view, as seen in FIG. 3, it is in the form of an elliptical curve, of approximately 90° curvature, having a vertical radial dimension, indicated at "*a*", almost twice the radial horizontal dimension, indicated at "*b*". Also, the curved edge portions 44 and 46 are so configured that in a front elevational view, as seen in FIG. 4, the upper portion of the curve has a generally circular configuration, having a radius of curvature slightly larger than that of a golf ball 26 which is inserted into or removed through the opening 24. Thus, the upper portion of the opening 24 is narrower and restricts movement of the golf ball 26 in that upper area, and the lower part of the opening 24 has a greater lateral dimension to enable a person to place his fingers on opposite sides of the golf ball held in the lowermost position and remove the golf ball more easily.

The interior of the containing device 10 can be considered as being divided into an upper containing chamber 48 and a lower dispensing chamber 50. The containing chamber 48 is bounded on its upper side by the closure member 32 and on its lower side by a horizontal plane, indicated at 52, located at the uppermost portion of the upper edge 46 of the opening 24. The dispensing chamber 50 is defined at its upper side by the plane 52 and its lower side by a horizontal plane 54 coincident with the lower defining edge 40 of the opening 24.

The retaining finger 28 has a rear mounting end 56 by which it is rigidly secured to the lower rear end of the base 38. When the finger 28 is formed by displacing material from the member 38, the mounting end 56 would be integral with the member 38. The finger 28 extends forwardly and upwardly at a moderate slant to provide a forward retaining portion 58 that extends into the area of the dispensing chamber 50 and terminates at the front end of the opening 24.

The finger 28 is sufficiently resilient that it can with moderate pressure be depressed to a lower dispensing position just below the lower plane 54 defining the dispensing chamber 50. Also, the finger 28 has an upper and rearwardly facing contact surface 62 adapted to engage the lowermost golf ball 26 located in the container 10.

In operation, the containing device 10 is loaded by inserting a ball 26 through the opening 24 in a manner to depress the retaining finger 28 to its lower position at or below the plane 54. Subsequent balls 26 are inserted in somewhat the same manner, with the ball 26 above being simply moved further upwardly in the container 10. In the particular containing device shown herein, three golf balls 26 can be held, this requiring that the total vertical dimension of the upper and lower chamber portions 48 and 50 combined be moderately greater than the total of the diameters of the three golf balls 26 being held.

With the balls 26 so placed in the device 10, even with substantial jostling and impacts on the device 10, the balls 26 remain securely retained in the housing 12. This is true, even though the impact forces of the balls 26 against the device 10 (caused by dropping the device or severely impacting it) are substantially in excess of the resisting force exerted by the retaining finger 28 on the balls 26. To explain this more fully, with reference to FIG. 3, it will be noted that in the normal retaining position, the lowermost ball 26 is positioned only partially in the dispensing chamber 50, with an upper portion of the ball 26 extending into the retaining chamber 48. When the device 10 is subjected to lateral impacts, which may tend to move the ball in a forward lateral direction, the upper edge 46 absorbs the greater portion of such impact, after which the ball may be deflected downwardly a short increment of travel, after which the ball 26 tends to move back up to its originally retained position.

In the instance where there is a sharp impact at the lower end of the device 10, even though the ball depresses the retaining finger 28 to its full down position because of the force of the impact, the result is that the ball is immediately pushed back upwardly to its original retained position. When downwardly and forwardly oblique impacts are encountered, the ball 26 tends to rebound off the retaining finger 28, thence upwardly against the front upper edge 46, and then back to its retaining position.

On the other hand, when it is desired to remove the lowermost ball 26, it is a simple matter to merely move the lowermost ball 26 downwardly, either by grasping the sides of the ball and depressing it against the finger 28, or actually engaging the finger 28 manually so that the ball drops into its dispensing position. Then the ball 26 is simply moved laterally through the opening 24 to remove it from the device 10.

In summary, the device is a simple and durable structure, which is able to perform its ball retaining function reliably, and yet enables the user to remove and insert balls with relative ease.

What is claimed is:

1. A golf ball holder adapted to be mounted to a golf club carrying device, such as a golf bag or a golf cart or the like where it is subjected to possible jostling and impacts, said holder particularly adapted to reliably hold a plurality of golf balls therein, in a manner that such golf balls can be readily inserted into and removed from the holder during actual golf play, said holder comprising:

a. an elongate, substantially rigid, tubular housing having upper and lower ends and having a generally unitary, cylindrical, circumferentially closed side wall, defining an elongate chamber having a diameter moderately larger than the golf balls to be retained, said chamber adapted to retain golf balls in a stacked arrangement at upper and lower locations therein, b. said housing having at its lower end a forwardly facing cut-out portion, having an edge section defining a loading and dispensing opening moderately larger than the diameter of the golf balls to be inserted into and dispensed from the holder, said edge section being characterized in that it is substantially continuous and has an upper curved edge portion only moderately larger than the golf balls to be retained therein, so as to provide greater reliability in retaining golf balls adjacent said upper edge portion, lateral edge portions having a lateral spacing greater than that across the upper curved edge portion to provide lateral access to a lowermost golf ball in said holder for removal from the holder, and a lower edge portion located at a predetermined level and connecting to the lateral edge portions, c. means to mount said holder to said golf club carrying device, and d. a resilient retaining finger cantilever mounted at a lower rear location in the holder at a location beneath the level of the lower edge portion of the loading and dispensing opening, said finger extending upwardly and forwardly to a forward location moderately above and adjacent to said lower edge portion, said finger having an upwardly and moderately rearwardly directed contact face having an upward and forward slant from said rear location to said forward location, so that said contact face engages a lower side of the lowermost positioned golf ball in its normal retained position on a slant to urge said golf ball rearwardly and away from said opening and hold said golf ball in said chamber, said finger having a forward end which in its normal position is at a distance from said edge section less than a distance equal to the diameter of the retained golf ball, whereby the edge section of the housing defining the opening coacts with the finger to retain the lowermost golf ball in the holder, said retaining finger being sufficiently resilient so as to be readily downwardly deflected to permit the lowermost golf ball to be removed forwardly through the opening or inserted into the holder through said opening.

2. The holder as recited in claim 1, further comprising an upper circular closure member fixedly connected to and extending across said housing at the upper end thereof, said closure member being provided with a plurality of spaced holes positioned about a circumferential edge of said closure member to provide a mounting for golf tees to be inserted in said holes from an exterior location without contact with a golf ball positioned in said chamber.

3. The holder as recited in claim 1, wherein there is a second golf tee mounting member fixedly connected to said housing at a location moderately below the upper closure member, said second member having a plurality of mounting holes in alignment with said holes of the upper closure member to provide more secure engagement with the golf tees in said holder.

* * * * *